United States Patent [19]

Margolin

[11] 4,132,306

[45] Jan. 2, 1979

[54] MAKE-UP CONTAINER CONSTRUCTION

[75] Inventor: Herbert E. Margolin, East Northport, N.Y.

[73] Assignee: Germaine Monteil Cosmetiques Corp., Deer Park, N.Y.

[21] Appl. No.: 861,763

[22] Filed: Dec. 19, 1977

[51] Int. Cl.[2] ..... A45C 11/00; B65D 25/02

[52] U.S. Cl. ..... 206/37; 132/79 C; 220/DIG. 26

[58] Field of Search ..... 206/37, 38; 220/DIG. 26; 132/79 C

[56] References Cited

U.S. PATENT DOCUMENTS

| | | | |
|---|---|---|---|
| 2,370,928 | 3/1945 | Baldanza | 220/DIG. 26 |
| 2,829,765 | 4/1958 | Burger | 206/37 R |
| 2,990,054 | 6/1961 | Gellman | 206/37 R |
| 3,214,012 | 10/1965 | Mack | 132/79 C |

*Primary Examiner*—William T. Dixson, Jr.
*Attorney, Agent, or Firm*—Wolder, Gross & Yavner

[57] ABSTRACT

An improved make-up container construction to allow for more efficient and economical utilization of the most expensive parts of a compact or lipstick case. There are provided a significant quantity of make-up inserts at the point of display. When the desired color is chosen, the inserts may be permanently secured to the lipstick or the case. The compact portion has a recess to engage a extended tapered lug secured to the insert portion. The various portions are made of resilient material to allow a snap-fit to occur. Once the lug is received within the recess, it cannot be removed.

Thus, by using the above construction, a much smaller number of other compact members and lipstick members are necessary.

8 Claims, 14 Drawing Figures

MAKE-UP CONTAINER CONSTRUCTION

BACKGROUND OF THE INVENTION

The present invention relates to an improved make-up construction, and more particularly to a construction which allows utilization of a wide variety of make-up inserts, with a small number of outer containers.

In the past, a manufacturer had to provide a whole series of compacts or lipsticks each containing a specific color. For each color pomade for a lipstick or for each pan insert for a compact, the outer lipstick case or the outer compact case had to be provided. Thus, depending on which colors were popular and which were unpopular, there would of necessity be a substantial inventory remaining at all times. Obviously, an historical basis could be developed, it would become obvious that certain colors were more popular than others and that upon reorder these colors would be ordered. However, this still left the manufacturer with the problem of attempting to guess which colors would be popular and which would not, and if the manufacturer guessed wrong, then it would be left with substantial inventory of little value.

The major expense in connection with lipsticks and compacts, is, of course, the outer casing. Thus, if a construction could be provided that would allow the variety of color, while reducing the overall cost of the inventory, a significant benefit would accrue to the manufacturer, and this would also be a resultant benefit to the retailer, and of course, the ultimate purchaser.

SUMMARY OF THE INVENTION

Accordingly, it is among the principal objects of the present invention to provide an improved make-up container construction for a compact or lipstick or in fact, any type of a cosmetic container, that will result in substantially reduced inventory requirements of the most expensive portions of such containers.

Still yet another object of the present invention is to provide a construction of the character described, which will allow the stocking of a substantial variety of cosmetic colors, at a low cost, and allow ultimate reordering and concentration upon the most popular colors.

Still yet another object of the present invention is to provide a construction of the character described, which will be simple and inexpensive to manufacture, yet will be durable to a high degree in use.

In accordance with the present invention, there is provided an improved make-up construction which broadly consists of an exterior container such as a compact having a base and a top portion enjoined at a hinge, or a lipstick container having a base and a cover, in which the outer container has a wall with a recess defined therein. The recess generally faces inwardly from the wall to the interior of the cosmetic container. A make-up insert having the desired color cosmetic is provided having a mating abutting wall with an outwardly extending tapered lug. At least one of the two walls is sufficiently resilient so that when the units are brought into contact and the insert is pressed downwardly into a mating well, there is some give in one of the walls, to allow the lug to pass against the outer wall and thence to be received within the recess. Once the insert is in position with the lug within the recess, it is not possible to remove the insert without destroying the outer element.

In the construction utilizing the compact, there is a recess formed by means of a ledge on an inner shoulder base of the compact shell. The pan insert has a corresponding tapered lug extending outwardly from an inner shoulder on the pan insert. The compact has pan well to receive the insert, and as the insert is pushed downwardly into the well, the lug is resiliently passed between the two shoulders, and are received within the recess formed in the base.

With respect to the lipstick, there is provided a refill member having a cup with at least two outwardly extending tappered lugs. The refill member is pushed downwardly into a receiving cup having two windows or two substantially rectangular openings defined therein. The lugs are resiliently positioned past the inner wall of the receiving cup and then snap outwardly and engage the upper surface of the window forming the desired fit.

The above and other objects of the present invention will become apparent from a reading of the following description taken in conjunction with the accompanying drawings which illustrate preferred embodiments thereof.

DESCRIPTION OF THE PREFERRED EMBODIMENTS

Figure 7:
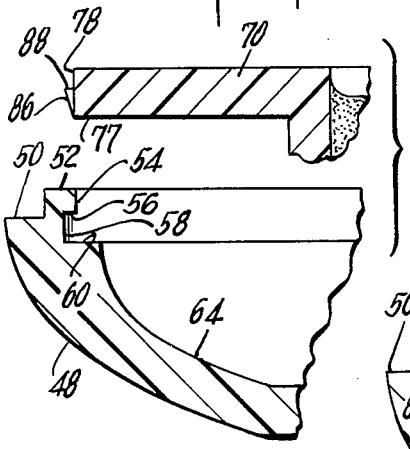
FIG. 7 is a cross-sectional view taken along the line 7—7 of FIG. 6.
Figure 8:
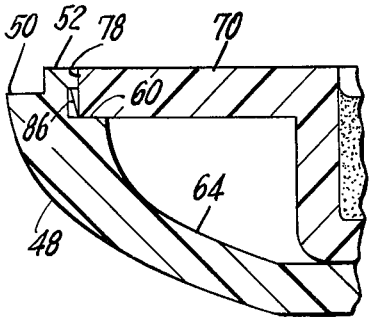
FIG. 8 is a view similar to FIG. 7, but showing the pan insert completely in position within the pan well and with the lug received within the recess of the compact base.
Figure 9:
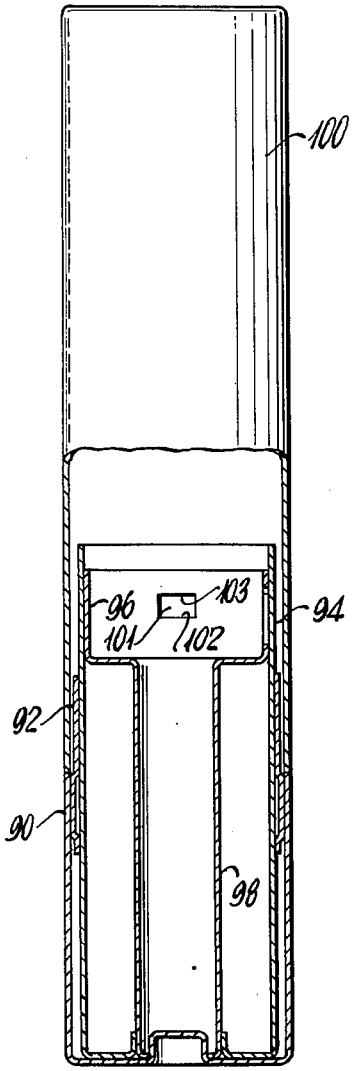
FIG. 9 is an elevational view of a lipstick container embodying the present invention with portions cut-away and taken along the line of 9—9 of FIG. 10.

Turning now to the drawings and more particularly to FIGS. 1–8, there is shown a make-up compact 10 embodying the present invention. The alternative equally important construction embodying the invention is shown in FIG. 9 in respect to a lipstick container.

Figure 4:
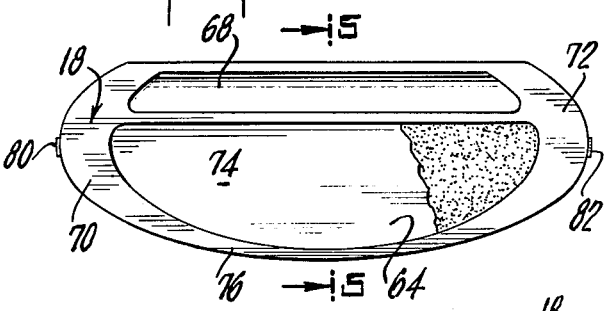
FIG. 4 is a top plan view of a pan insert also showing cosmetics contained partially therein.
Figure 5:
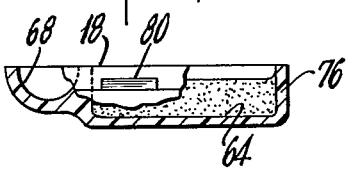
FIG. 5 is a sectional view taken along the line 5—5 of FIG. 4, partly cut-away and showing cosmetic placed therein.

The compact consists of a cover 14, a base 16, and a pan insert 18 (FIG. 4). The cover 14 is defined by an upper surface 20 and a lower surface 22 having defined therein a receptacle 24 to receive a mirror 26. The front portion has a female clasp member 28 and the rear portion has a hinge portion 30 with a thru bore 32 defined therein. The base 16 is also defined in the rear by a hinge portion 34 having a continuation of the same thru bore 32. The base also has a pan well insert 36 which is defined by rear wall 38, left side wall 40, right side wall 42, and a front wall 44. The front wall has defined therein the male hinge portion 46.

Figure 3:
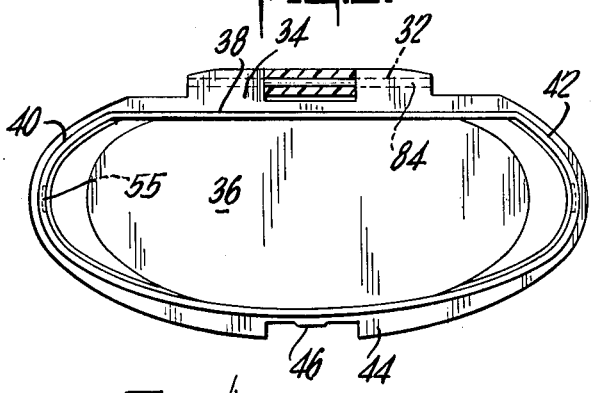
FIG. 3 is a top plan view of the base of the outer compact.

Turning to FIG. 7, the outer surface 48 of the base terminates in an outer shoulder 50 which extends substantially around the base of the compact. However, the only interest as respects the invention is on the sides. Extending upwardly from the shoulder 50 is a ridge 52 which extends completely around the base and is generally oval in appearance seen in FIG. 3. Depending downwardly and inwardly from the shoulder 50 is an inner surface 54. As best seen in FIG. 3, for a short distance along both side walls 40, 42 there is defined a recess 55 basically consisting of an inwardly extending shoulder 56, and undercut vertical wall 58 and underwall 60 which continues inwardly forming shoulder 62 which thence becomes an inner wall 64 defining the pan well 36. The recess may be further defined by side walls or the walls may extend and eventually blend into the inner surface 54. The shoulder 62 and the underwall 60 combine to form a ledge 66 which supports a mating surface of the pan insert.

Figure 6:
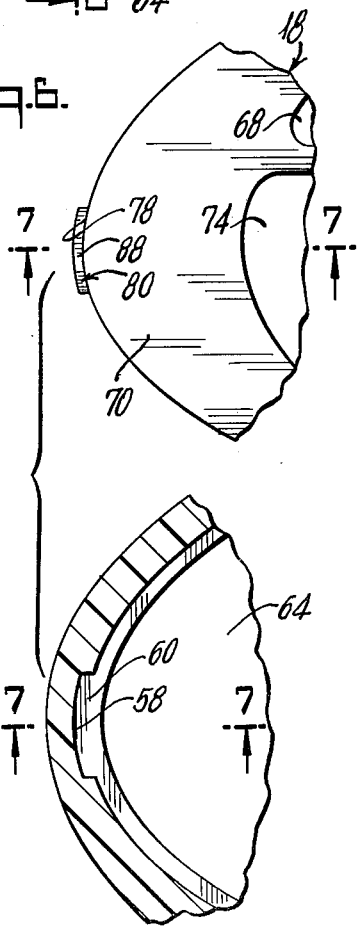
FIG. 6 is an exploded view showing the pan insert about to be positioned within the base of the compact.

Turning to the pan insert, and more particularly to FIGS. 4, 6, and 7, the insert 11 is defined generally by a rear wall 68, a left-side wall 70, a right-side wall 72, defining a cosmetic well 74 which is further enclosed by a front wall 76.

Paying particular attention to FIG. 7, the wall has a lower outer surface portion 77 and a side shoulder 78. Depending outwardly from the shoulder 78 is a left tapered lug 80. There is a right tapered lug 82 depending from the other side in the same fashion. The lug 80 more specifically consists of a wedge with a tapered surface 86 and a top shoulder 88.

Finally, it should be mentioned that there is a pin 84 to retain the top and base of the compact in operative condition.

Figure 1:
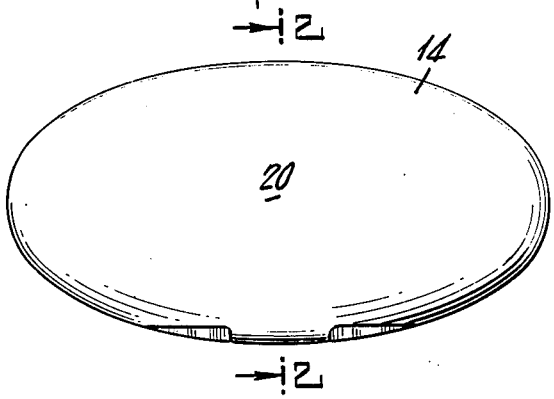
FIG. 1 is a top plan view of a compact of an improved make-up container construction.
Figure 2:
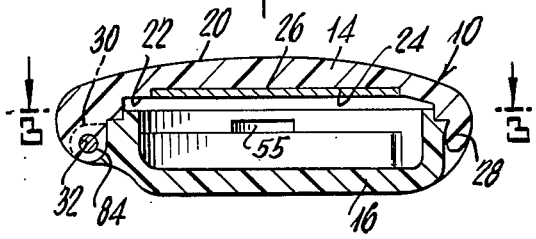
FIG. 2 is a sectional view taken along the line 2—2 of FIG. 1 and showing the compact shell without the insert.

Turning now to the operation of the present mechanism, it is apparent that the compact shell consisting of the top 14 and the base 16 as shown in FIGS. 1 and 2, may be used for any one of a variety of different pan inserts 18 having a different cosmetic color in the cosmetic well 74. Thus, for example, it may only be necessary for a store to stock twenty-five to thirty cover base combinations, while stocking one hundred to two hundred different pan inserts containing different colors. When a customer has made a selection of the desired color, then the pan insert is placed in the position shown in FIGS. 6 and 7 above an empty base. The pan insert is pressed downwardly until the surface 86 of the lug begins to engage the inner surface 54 of the base. Continued pressure will cause one of the other of the elements to resiliently "give" to allow the lug to continue passing by the surface 54 until the apex passes completely down the whole length of surface 54. At that point the lug will snap into the recess 55 with the surface 88 abutting the surface 56. In this position, as seen in FIG. 8, the pan insert is firmly and permanently engaged within the compact base.

Turning to FIGS. 9–14, there is illustrated the same invention, but used in connection with lipstick. The make-up lipstick container 12 is of a wellknown type which includes a base 90, a collar 92, with a sliding sleeve 94 which may be moved up and down vertically, as desired, to protect the pomade. Positioned within the base is a support cup 96 mounted on a pedestal 98 secured to the base. The cup also acts as an inner guide means for the sleeve 94. The unit is normally enclosed by a decorative cover 100.

Figure 11:
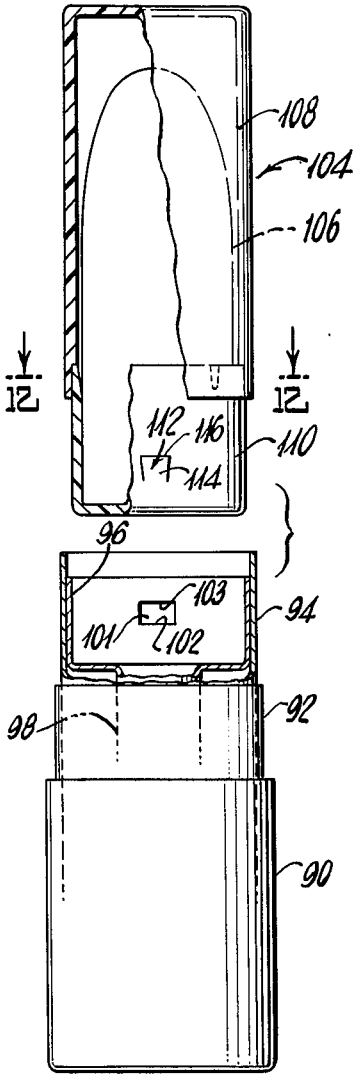
FIG. 11 is an exploded view of the lipstick container with the cap removed and showing the pomade enclosed by its dust cover about to be positioned within the support cup.
Figure 13:
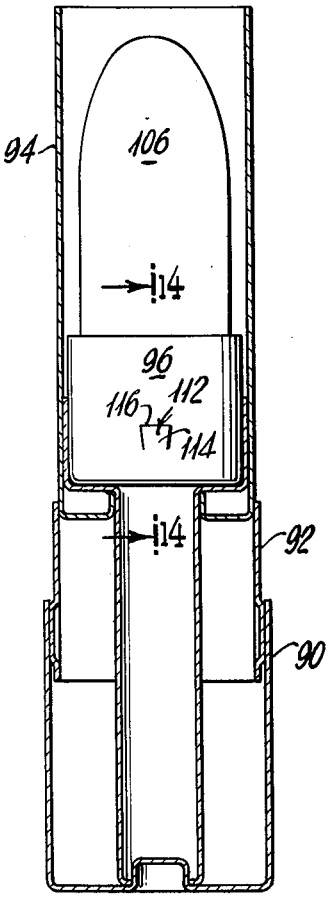
FIG. 13 is a view similar to FIG. 11, but showing the pomade insert positioned within the support cup, and with the lug engaging the recesses.
Figure 10:
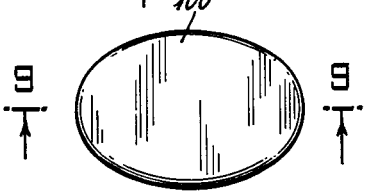
FIG. 10 is a top plan view of the lipstick container.
Figure 12:
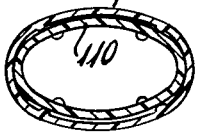
FIG. 12 is a sectional view taken along the line 12—12 of FIG. 11.
Figure 14:
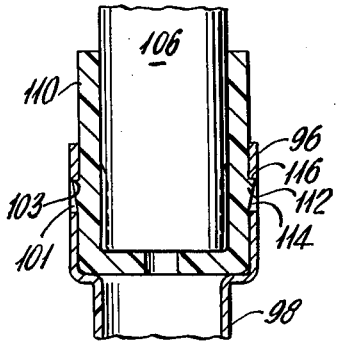
FIG. 14 is a sectional view taken along the lines 14—14 of FIG. 13.

Turning to FIGS. 9 and 11, there is seen the recess 101, which in essence is a window or a rectangular opening 102 having an upper wall 103.

The refill member 104 consists of a pomade 106, a dust cover 108, with the pomade being maintained within a refill cup 110. Integrally formed in the sidewalls 111 of the cup 110 are tapered lugs 112 having an outwardly extending side surface 114 and an upper shoulder or surface 116. The outer diameter of the dust cover 108 is the same as the outer diameter of the sliding sleeve 94. Therefore, when the dust cover and pomade is inserted within the cup 96, the dust cover may be ejected by means of upward vertical movement of the sliding sleeve 96. This permits the pomade to be free of manual contact after insertion of the refill cup 110 into the support cup 96. It also ensures the removal of the dust cover without risk of marring the pomade finish.

It should readily be apparent that in operation, once the desired pomade color has been selected by the customer all that is necessary is to place the refill member 104 in the position shown in FIG. 11 with pressure then being applied until the refill cup 110 is received within the support cup 106. Further pressure will cause the lugs to engage the inner surface of the cup and the resiliency of one or the other members will cause the lugs to pass inwardly past the surface until they are received within the recess 101, the lugs then snapping into the recess, with the upper surface 116 of the lug bearing against the upper surface 103 of the recess 101. Furthermore, by vertical upward movement of the sleeve 94 the dust cover 108 is ejected and removed, thus exposing the pomade 106. The lipstick is then used in the wellknown fashion.

The compact may be composed of any desirable type of metal or plastic as long as there is sufficient flexibility in the length of the insert to allow the lug to be snapped into position. A plastic which accomplishes all of the above results and which may be used for all elements of the compact is styrene acribultryl (SAN). With respect to the lipstick all the parts are of thin gauge sheet metal, except the base is made of propylene and the dust cover is made of styrene acribultryl (SAN).

Thus, it has been shown that a new and unique form of a construction for a lipstick or a compact has been provided in which the necessity for expensive inventory is drastically reduced. The joinder of the pomade or the pan insert to the lipstick or compact, respectively. it very easily accomplished and is for all intense purposes permanent. This construction allows much greater control over inventory, and especially the more expensive portions of the inventory.

While there have been described and illustrated preferred embodiments of the present invention, it is apparent that numerous alterations, omissioners and additions may be made without departing from the spirit thereof.

I claim:

1. An improved make-up container construction to allow more economical utilization of the more expensive portion of the construction with a variety of different cosmetic inserts, comprising:

a. a make-up container having a wall
b. a recess defined in the wall
c. a make-up insert having a wall, the insert wall and the container wall being proximate to each other when the insert and the container are in cooperative engagement
d. an outwardly extending tapered lug secured to the insert wall and adapted to be permanently received within the recess
e. at least one of the two walls having sufficient resiliency to allow the lug to snap fit into the recess whereby any one of the desired make-up inserts may be positioned within the container at the point of purchase, rather than the point of manufacture.

2. The invention according to claim 1, wherein the make-up container is a compact consisting of a base and a top.

3. The invention according to claim 2, wherein the base has a wall containing the recess, the recess being defined by an inner shoulder an undercut and an underwall, the lug having an upper surface abutting and permanently engaging the inner shoulder.

4. The invention according to claim 3, the recess further being defined by an underwall extending into an inner shoulder forming a ledge, the pan insert having a lower surface abutting and being supported upon the ledge when said lug is positioned within the recess.

5. The invention according to claim 1, the container being a lipstick container.

6. The invention according to claim 5, the lipstick container having a base, a support cup the pedestal depending therefrom, being supported within the base, the recess being formed in the wall of the support cup.

7. The invention according to claim 6, the make-up insert consisting of a refill cup containing a pomade, the refill cup having the lugs integrally formed therein.

8. The method of forming a make-up container construction comprising: the steps of:

a. providing a make-up container having a wall with a recess defined therein
b. providing a make-up insert having a wall with a tapered lug extending therefrom
c. providing a variety of colors of cosmetics with a variety of make-up inserts and selecting a desired insert
d. placing said insert within the container so that the lug is permanently received within said recess.

* * * * *